US010867534B2

(12) United States Patent
Bloomberg et al.

(10) Patent No.: US 10,867,534 B2
(45) Date of Patent: Dec. 15, 2020

(54) ILLUMINATED SIGN ASSEMBLY

(71) Applicant: Gensler Architecture, Design & Planning, P.C., New York, NY (US)

(72) Inventors: Mitchell Bloomberg, Kearny, NJ (US); Boris Bregman, Kearny, NJ (US); Peter Wang, New York, NY (US); Niti Dattani, New York, NY (US)

(73) Assignee: Gensler Architecture, Design & Planning, P.C., New York, NY (US)

( * ) Notice: Subject to any disclaimer, the term of this patent is extended or adjusted under 35 U.S.C. 154(b) by 0 days.

(21) Appl. No.: 16/415,056

(22) Filed: May 17, 2019

(65) Prior Publication Data

US 2020/0365065 A1 Nov. 19, 2020

(51) Int. Cl.
*G09F 13/18* (2006.01)

(52) U.S. Cl.
CPC ..... *G09F 13/18* (2013.01); *G09F 2013/1881* (2013.01)

(58) Field of Classification Search
CPC ..... G09F 2013/184; G09F 2013/1845; G09F 2013/1881; G09F 13/18
See application file for complete search history.

(56) References Cited

U.S. PATENT DOCUMENTS 4,318,238 A * 3/1982 Macarle, Jr. ..... G09F 7/00 116/63 P
4,435,743 A * 3/1984 Plumly ..... G02B 6/0083 362/184
5,022,627 A 6/1991 Beghelli
5,224,439 A * 7/1993 O'Connell ..... B60Q 7/02 116/201
5,335,434 A * 8/1994 Shultz ..... A47G 1/0605 40/746
5,964,051 A * 10/1999 Loeber ..... G09F 13/04 362/249.03
5,988,825 A 11/1999 Masters et al.
6,106,126 A 8/2000 Neustadt
6,152,581 A 11/2000 Masters et al.
6,823,618 B2 11/2004 Huang
8,998,440 B1 4/2015 Wu et al.
9,651,215 B1 5/2017 Britten et al.
2007/0289180 A1* 12/2007 Johnson ..... G02B 6/0068 40/546
2011/0041371 A1 2/2011 Grauer
(Continued)

FOREIGN PATENT DOCUMENTS

EP 2474966 7/2012

OTHER PUBLICATIONS

Zumbotel Product.

*Primary Examiner* — Cassandra Davis
(74) *Attorney, Agent, or Firm* — Kane Kessler, P.C.; Paul E. Szabo

(57) ABSTRACT

A sign assembly such as an exit sign can be mounted on either a wall or a ceiling of a structure. The sign assembly includes a housing with a frame that supports a square lens. The frame has one wall section that is removable to enable the lens to be removed and reinserted in a different orientation relative to the frame. As a result, the lens can be oriented properly when the sign housing is turned to be mounted on either the wall or the ceiling. The lens is free of electrical contacts and electrical terminals.

7 Claims, 6 Drawing Sheets

(56) References Cited

U.S. PATENT DOCUMENTS

| | | | | |
|---|---|---|---|---|
| 2011/0138665 | A1* | 6/2011 | Liu | F21S 9/022 40/570 |
| 2011/0239504 | A1 | 10/2011 | Keuning | |
| 2012/0075112 | A1 | 3/2012 | Sundholm | |
| 2013/0199064 | A1 | 8/2013 | O'Kell | |
| 2015/0228211 | A1* | 8/2015 | Curic | G09F 15/0012 40/541 |
| 2015/0332616 | A1* | 11/2015 | Ports | G09F 7/18 40/544 |
| 2018/0314001 | A1* | 11/2018 | Veenstra | A47F 3/001 |
| 2019/0012940 | A1 | 1/2019 | Hinton | |

* cited by examiner

ILLUMINATED SIGN ASSEMBLY

BACKGROUND OF THE INVENTION

The present invention relates to an illuminated sign assembly. One embodiment is a sign for use in a structure, in particular an exit sign in a building The exit sign needs to be illuminated so that it can be seen in low light conditions. The various exit signs in a building will, depending on their location, have different markings, directing people to move in one direction or another, or different wording. Some exit signs must be mounted on the wall, others on the ceiling, some flush and some projecting, and some hanging from a pendant. Typically a number of different configurations of exit signs must be provided for one building to accommodate all these different usages. In each case, the marking on the sign must be oriented so that it is readable by a person standing on the building floor. These issues are not limited to exit signs, but are applicable also to other types of signs, such as room location signs, general directional signs, etc.

SUMMARY OF THE INVENTION

In accordance with one aspect of the invention, a sign assembly for mounting on a building structure includes a housing and a lens removably supported in the housing. The housing included a base configured for mounting on either a wall or a ceiling of a structure such as a building. The lens has a marking for providing information to a viewer, the marking being fixed in a particular orientation on the lens. The housing includes a frame for receiving the lens and supporting the lens with the marking in a first orientation relative to the housing. The lens is removable from the frame and re-insertable into the frame with the marking in a second orientation relative to the housing that is different from the first orientation. The sign assembly includes an illumination mechanism inside the housing to direct light toward the lens to illuminate the lens when the lens is in the frame. The lens is free of electrical contacts and electrical terminals. The lens when fitted into the support frame in the first orientation has a first edge adjacent to the illumination mechanism for receiving light into the lens to make the lens marking visible. The lens when fitted into the support frame in the second orientation has a second edge that is different from the first edge adjacent to the illumination mechanism for receiving light into the lens to make the lens marking visible.

In accordance with another aspect of the invention, a sign assembly for mounting on a building structure includes a housing and a lens removably supported in the housing. The housing includes a base configured for mounting on either a wall or a ceiling of a structure such as a building. The lens has a marking for providing information to a viewer, the marking being fixed in a specific orientation on the lens. The housing includes a three sided frame extending from the housing base for receiving the lens and for supporting the lens with the marking being in a first orientation relative to the housing. The lens is removable from the frame and re-insertable into the frame with the marking in a second orientation relative to the housing that is different from the first orientation. The three sided frame includes parallel first and second frame side sections that are fixed to the housing and extend outward from the housing and a third frame side section that extends between and interconnects outer end portions of the first and second frame side sections. The third frame side section is removable from the first and second frame side sections to enable removal of the lens from the frame and insertion of the lens into the frame in a selected orientation.

BRIEF DESCRIPTION OF THE DRAWINGS

Further features of the invention will become apparent to one of ordinary skill in the art to which the invention pertains from a reading of the following specification together with the accompanying drawings, in which.

DESCRIPTION OF AN EMBODIMENT OF THE INVENTION

Figure 1:
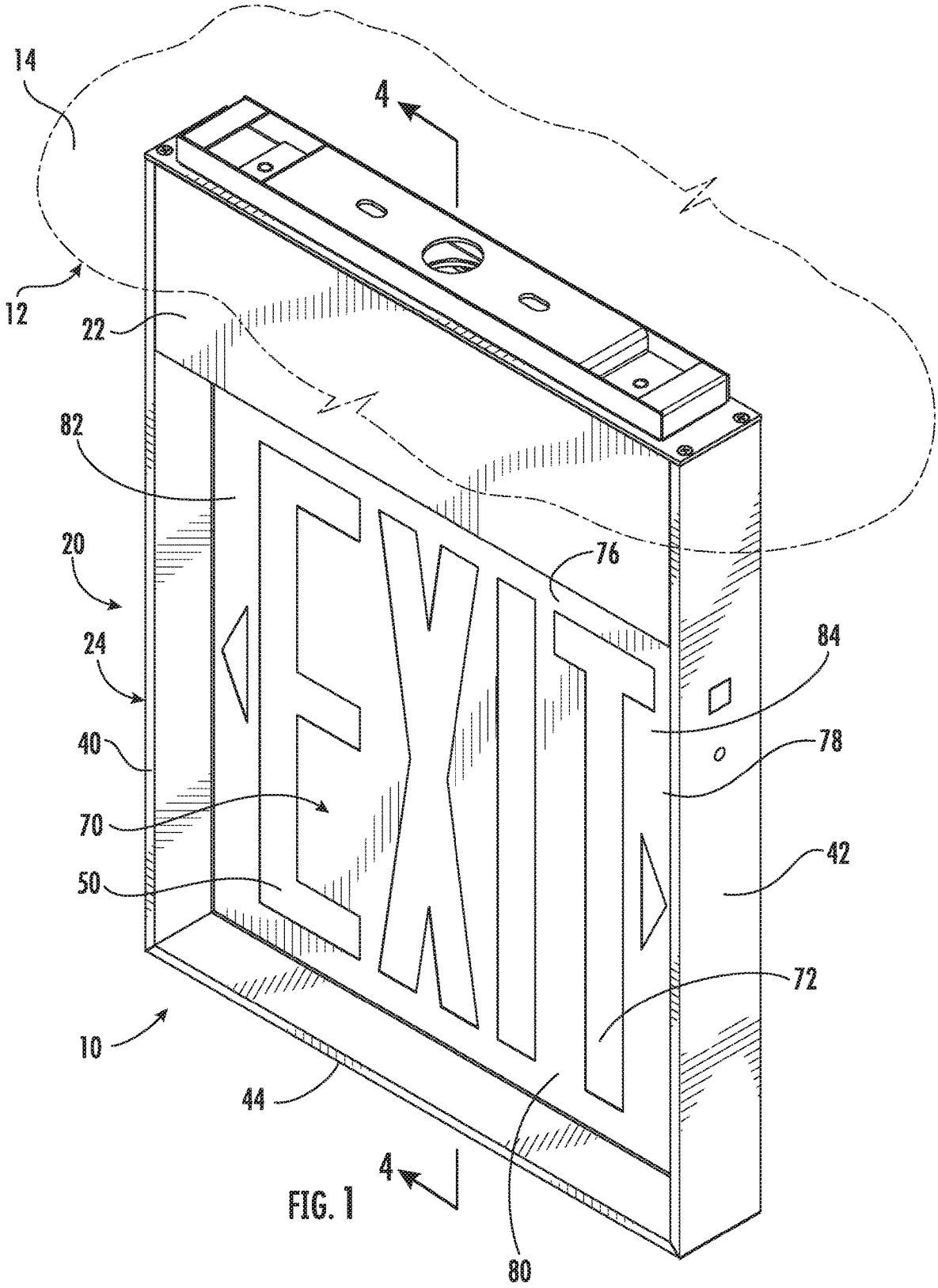
FIG. 1 is a perspective view of a sign assembly that is a first embodiment of the invention, shown mounted on a ceiling of a structure.

The present invention relates to an illuminated sign assembly. The invention is applicable to sign assemblies of different and varying configurations. As representative of the invention, FIG. 1 illustrates a sign assembly 10 that is a first embodiment of the invention.

Figure 2:
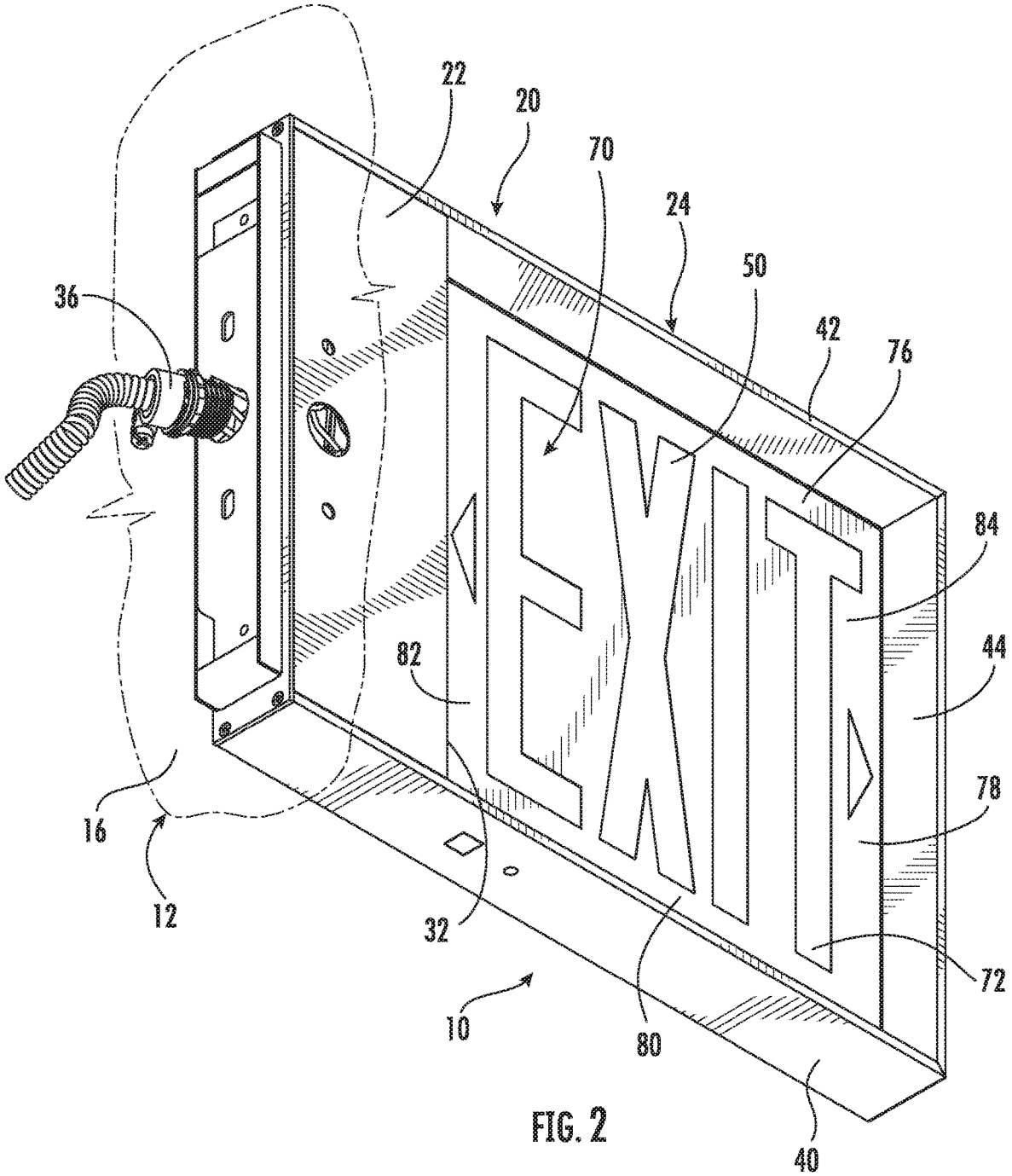
FIG. 2 is a perspective view of the sign assembly of FIG. 1 shown mounted on a wall of a structure.
Figure 3:
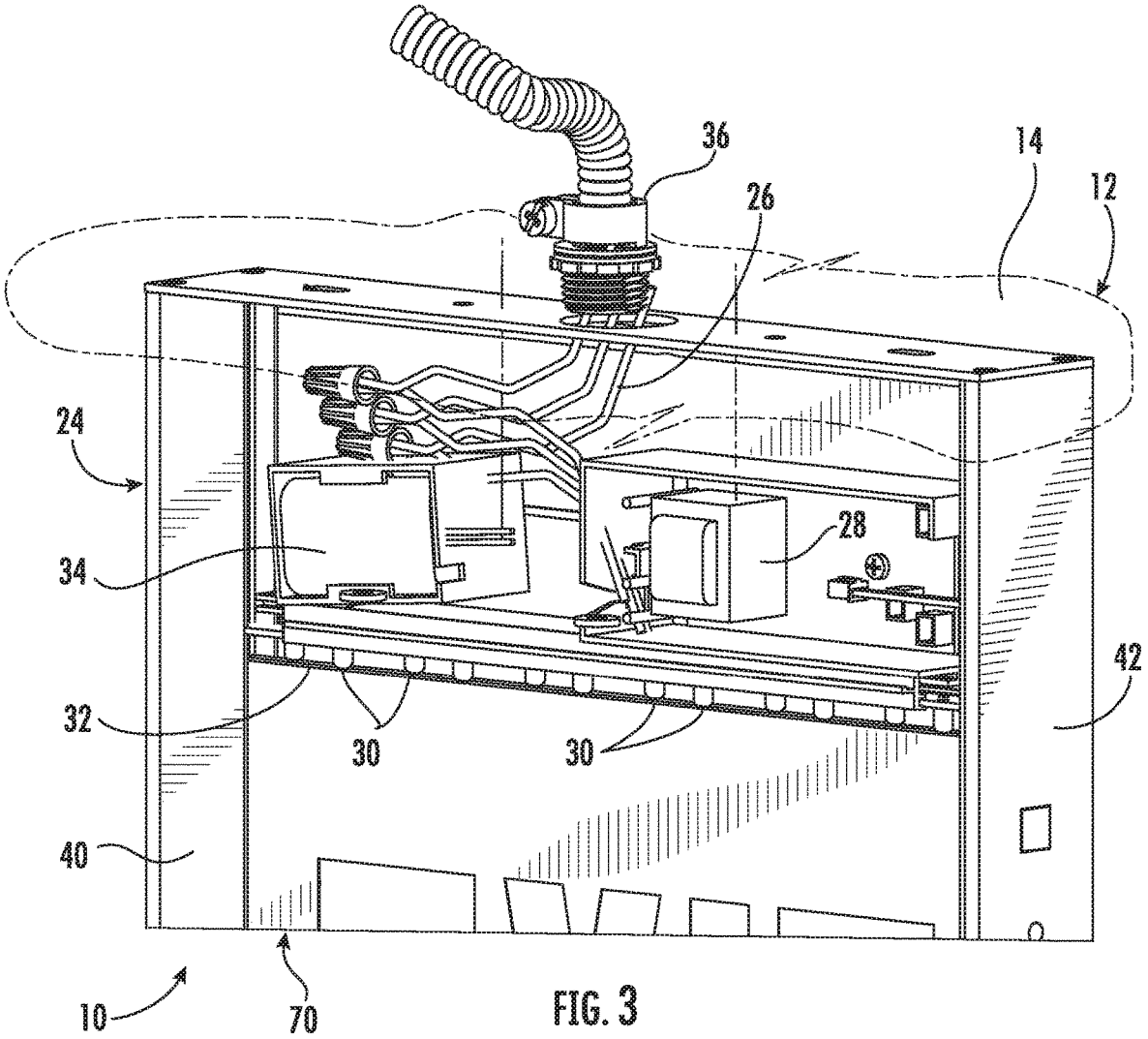
FIG. 3 is an enlarged broken away view of a portion of the sign assembly of FIG. 1.
Figure 4:
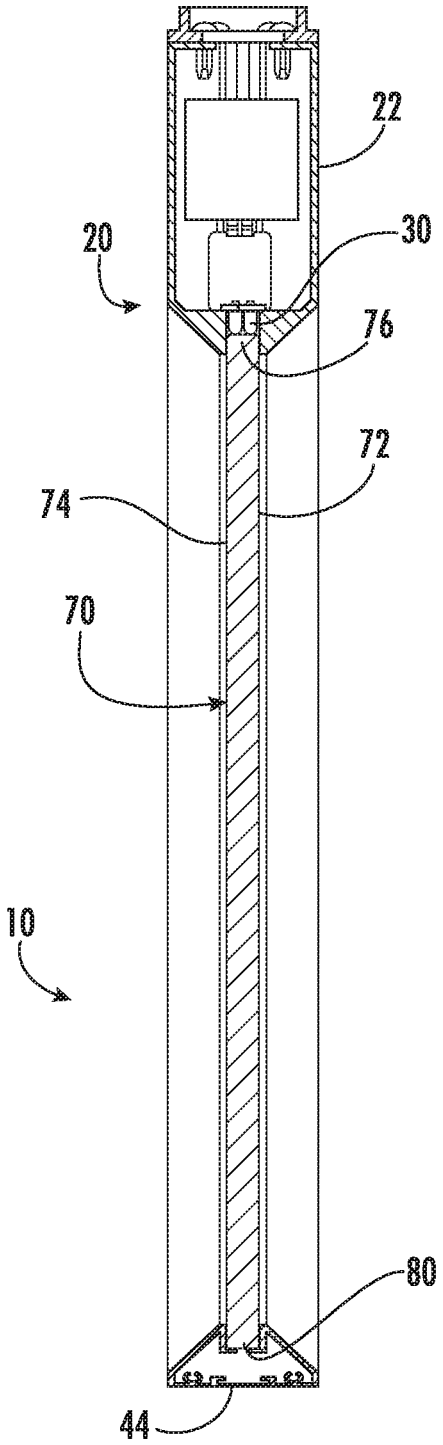
FIG. 4 is a sectional view of the sign assembly of FIG. 1.

The sign assembly 10 is configured, as described below, for mounting on a building or other structure 12, including on a wall or a ceiling of a structure, as illustrated schematically in FIGS. 1-3. Specifically, FIGS. 1 and 3 show the sign assembly 10 mounted on a ceiling 14. FIG. 2 shows the sign assembly mounted on a wall 16.

The sign assembly 10 includes, as its major component parts, a housing 20 and a lens 70 that is removably supported in the housing. As described below in detail, the housing 20 is mounted on the structure 12; the lens 70 has a marking 50 for providing information to a viewer; and the marking is fixed in a specific orientation on the lens but the lens can be reoriented in the housing 20 in accordance with the invention.

It should be noted that the drawings show only one lens 70 mounted in the housing 20. In practice, a sign assembly in accordance with the invention could include two lenses back to back mounted in the housing, with differently oriented markings, so that the sign assembly can correctly be viewed from both sides. The invention is applicable in all aspects to a sign assembly including either one or more lenses.

The housing 20 includes as its major component parts a base 22 and a three-sided frame 24. The base 22 has a rectangular box-shaped configuration. Inside the base 22 are located the electrical components of the sign assembly 10. The electrical components receive electricity from the structure 12 via wiring 26. The wiring 26 extends to a transformer 28 which provides power to a row of lamps 30. The lamps 30 are preferably LEDs. The lamps 30 are arrayed in a single row along the lower side 32 (as viewed in FIG. 2) of the base 22. This is the side of the base 22 from which the frame 24 extends. The base side 32 is open so that light from the lamps 30 is directed into the interior of the frame 24. The base 22 also houses a battery backup 34 for the sign assembly 10.

The base 22 has mounting portions 36 configured for mounting the housing 20 on either a wall or a ceiling of a structure 12 such as a building. These mounting portions 36 can be of any conventional type; various types are known to those of ordinary skill in this art. The mounting portions 36 can be fasteners, screws or bolts, electrical wiring connections, etc. The mounting portions 36 can be configured to mount the sign assembly 10 flush on a surface, or projecting from a surface, or hanging down from a ceiling on a rod, etc. Alternatively, the sign assembly 10 can be mounted as a linear fixture in a suspended ceiling.

The frame 24 is a three sided frame, extending from the base 22, for receiving the lens 70 and for supporting the lens in position on the housing 20. The frame 24 includes parallel first and second frame side sections 40 and 42 and a third frame side section 44.

The first and second frame side sections 40 and 42 are fixed to the base 22 and extend outward from the side 32 of the base. The first frame side section 40 has an outer end portion 46. The first frame side section 40 has an inside slot for slidably receiving an edge of the lens 70. The second frame side section 42 is a mirror image of the first frame side section 40, having an inside slot for receiving an edge of the lens 70 and having an outer end portion 52.

Figure 5:
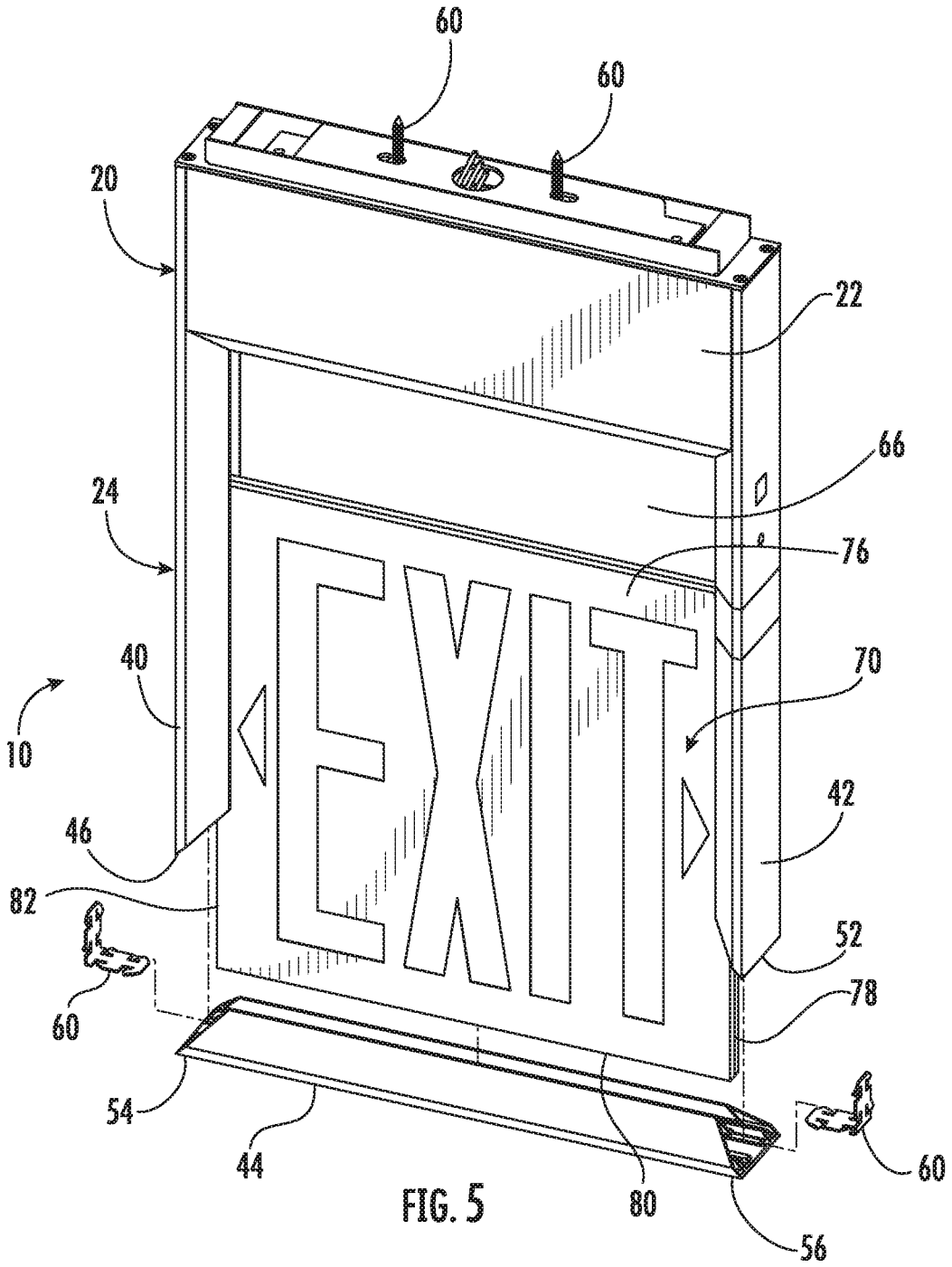
FIG. 5 is a partially exploded perspective view of the sign assembly of FIG. 1 showing a step in the replacement or reorientation of the lens.
Figure 6:
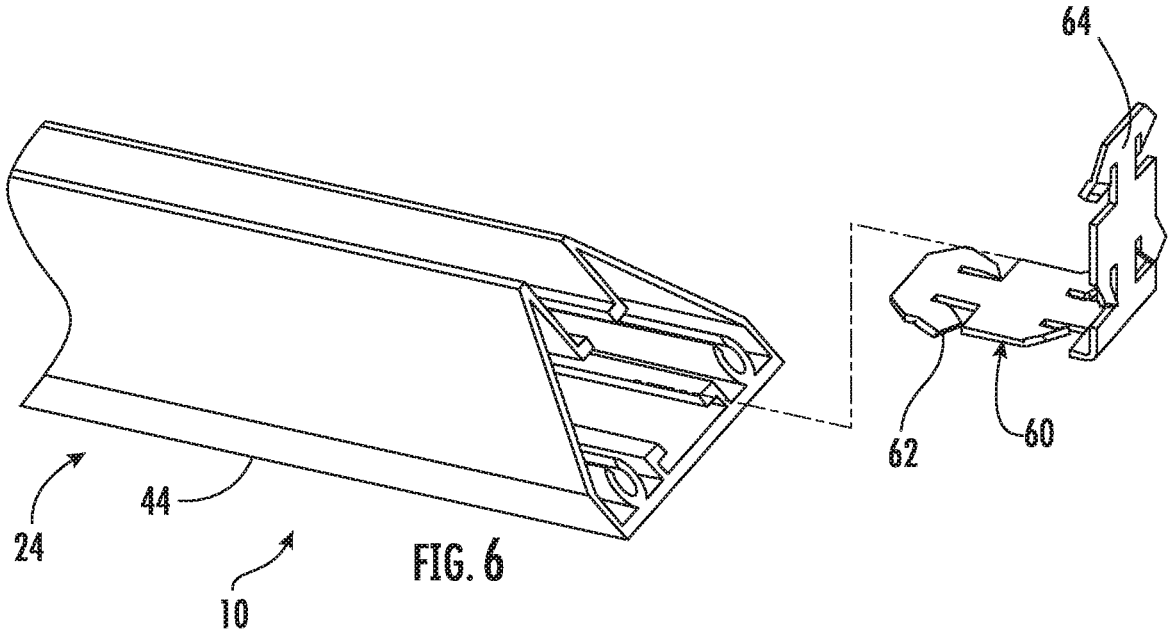
FIG. 6 is an enlarged view showing a clip that is used in assembly of a frame of the sign assembly.
Figure 7:
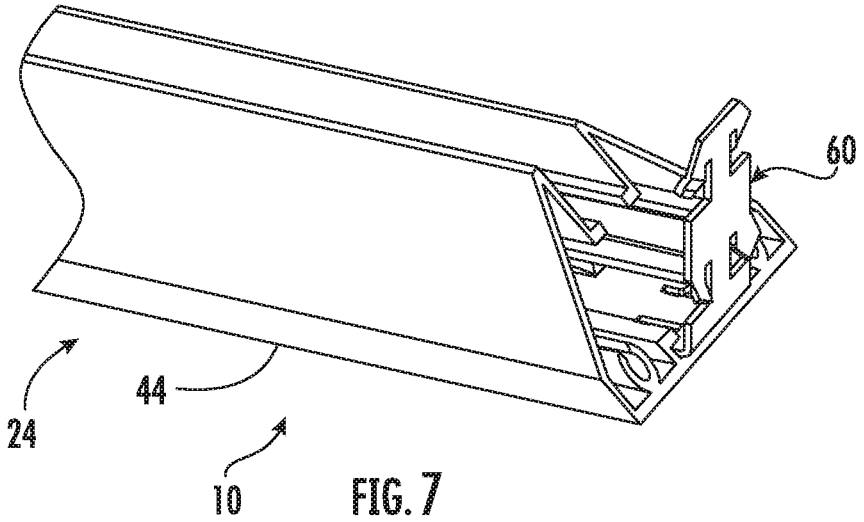
FIG. 7 is an enlarged view similar to FIG. 6 showing the clip installed in a frame section.

The third frame side section 44 extends between and interconnects the outer end portions 46 and 52 of the first and second frame side sections 40 and 42, respectively. The third frame side section 44 has a first end portion 54 that connects with the outer end portion 46 of the first frame side section 40. The third frame side section 44 has a second end portion 56 that connects with the outer end portion 52 of the second frame side section 42. As best seen in FIGS. 5-7, each one of the first frame side section 40 and the second frame side section 42 and the bottom frame section 44 has a generally triangular cross sectional shape providing a beveled configuration and appearance, on both sides, to the three sided frame 24. At the inner apex of each one of these three parts 40, 42, and 44 is located the inside slot for receiving an edge of the lens 70.

The third frame side section 44 is removable from the first and second frame side sections 40 and 42 to enable removal of the lens 70 from the frame 24 and insertion of the lens into the frame in a selected orientation. This is accomplished by the use of two fasteners in the form of clips 60. Each clip 60 has a L-shaped configuration including a first leg 62 and a second leg 64. The first leg 62 fits into an outer end portion of a frame side section 40 or 42. The second leg 64 fits into an outer end portion of the third frame side section 44. The clips 60 when in place secure the third side section 44 of the frame 24 to the other parts of the frame.

When the frame 24 is thus assembled, the frame is square, and defines an opening 66 in the frame, for the lens 70, which is square. The lens 70 is made from a flat piece of light transmitting material with a square configuration. Acrylic plastic is one suitable material. The lens 70 has first and second parallel major side surfaces 72 and 74 interconnected by four edges 76, 78, 80, and 82. The lens 70 is at least partially coated on one or both of its major side surfaces 72 and 74, but not on the four edges, with an opaque material 84. The opaque coating 84 is removed or absent at selected areas, to as to provide the marking 50. In the illustrated embodiment, the coating 84 on the first major side surface 72 is selectively absent to provide a marking 50 that is the work 'EXIT' along with two directional arrows. Different markings 50 can, of course, be provided, to provide signs of different characters and utility. Thus, the invention is not limited to exit signs, but may be used with room location signs, general directional signs, etc.

The lens 70 is not electrical or electrified, that is, it does not have contacts or terminals or lights. Rather, the lens 70 is a simple transparent or translucent material, edge lit by light that enters from the lamps 30 on the housing 20. As a result, the lens 70 can be in the frame 24 in any of four of its possible orientations relative to the housing 20 and still be illuminated, without the need for having terminals to contact a portion of the housing.

When the lens 70 is inserted into the frame 24, one of the four edges 76-82 of the lens is adjacent to the base 22 of the housing 20—in FIG. 1, the edge 76. That adjacent edge 76, like the other three edges, is not covered with the coating 84. As a result, light that emanates from the lamps 30 in the base 22 of the housing 20 is directed into the interior of the lens 70. The light can exit the lens 70 through the uncoated areas on the major side surfaces 72 and 74; when this occurs, the marking 50 is illuminated as desired.

The lens 70 when in the frame 24 is in a particular first orientation relative to the frame. The lens 70 is easily removable from the frame 24 and re-insertable into the frame 24 with the marking 50 in a second orientation relative to the housing 20 that is different from the first orientation.

To accomplish this, the user first removes the third frame side section 44 from the first and second frame side sections 40 and 42. Specifically, the clips 60 are pulled out of the first and second frame side sections 40 and 42, remaining with the third frame side section 44. At this point, the frame 24, which is still attached to the base 22, is open on one side.

The user then slides the lens 70 out of the frame 24. As this sliding movement occurs, the edges 82 and 78 of the lens 70 slide along the slots of the first and second frame side sections 40 and 42.

The user can then, if desired, change the orientation of the lens 70 relative to the frame 24. For example (FIG. 2) the lens 70 can be rotated and reinserted ninety degrees relative to the frame 24, because the lens 70 and the lens opening 66 are square. The user then can reinsert the lens 70 into the frame 24. The edges 76 and 80 of the lens 70 slide into the slots in the first and second side sections 40 and 42 of the frame 24. The lens edge 82 is moved to a position adjacent to the lamps 30 in the base 22, so that light from the lamps is directed into the interior of the lens 70.

With the lens 70 being in a different orientation relative to the base 22, the marking 50 is in a different orientation relative to the base. As a result, when the sign assembly 10 is mounted at a different orientation relative to the structure 12, and the marking 50 will still be readable because it is property oriented relative to the floor of the structure, on which a person would stand.

This feature is illustrated in a comparison of FIGS. 1 and 2. In FIG. 1 the sign assembly 10 is mounted on a ceiling 14. The marking 50 is upright and readable. In FIG. 2, the same sign assembly 10 is mounted on a wall 16, yet the marking 50 is still upright and readable. Thus, a single sign assembly 10 can be provided that is usable on either a wall or a ceiling, depending on the user's choice.

Because of this adaptability, any one particular sign assembly 10 can be moved from one location to another, by using different mounting portions. Alternatively, when providing signage for a building, a number of identical sign assemblies, only needing with different mounting portions, can be provided for a structure, regardless of whether they are to be used for wall or ceiling mounting. Having to vary only the mounting portions, rather than the entire sign assemblies, makes the process of supplying and installing a large number of sign assemblies significantly easier and less expensive.

As noted above, the lens 70 is free of electrical contacts and electrical terminals. That is, there is no structure on or in the lens 70 that receives electric power from the housing 20 or from the electrical mechanism in the housing 20. All illumination of the lens 70 comes from light sources that are external to the lens, such as the lamps 30. The lens 70 is manufactured and configured to be properly illuminated from at least two edges, and in some cases no matter what edge it receives its illumination from. This is because any given one of the lens edges can be positioned adjacent to the lamps 30, to receive light into the lens 70. When the lens 70 is reoriented in the housing 20, the lens is illuminated from a new edge of the lens. Thus, no electrical terminals or contacts are needed on the lens 70, and the lens can be simpler and more reliable than a lens that is required to have electrical terminals or contacts on two or more sides to enable re-orientation.

In addition, the invention provides an easy lens replacement or reorientation process. The user simply needs to remove the third frame side section 44, slide the lens 70 out of the frame 24, slide the same or a new lens in, in the desired orientation, and replace the third frame side section 44 with the clips 60. There is no need to take apart the entire housing 20.

From the above description of the invention, those skilled in the art will perceive improvements, changes and modifications in the invention. Such improvements, changes and modifications within the skill of the art are intended to be covered by the appended claims.

The invention claimed is:

1. An illuminated exit sign for mounting on a building structure and having markings for directing the movement of a person in the building, the exit sign comprising:

a housing; and a light transmitting lens removably supported in the housing, the lens having a marking for providing exit information to a viewer and having first and second major side surfaces;

the housing including a rectangular box-shaped base configured for mounting on a wall or a ceiling of a building, the base being a top portion of the sign when mounted on the ceiling;

the housing also including a frame and receiving the lens and supporting the lens with the marking in a first orientation relative to the housing;

the lens being free of electrical contacts and electrical terminals;

the exit sign including an illumination mechanism inside the base to direct light toward the lens to illuminate the lens when the lens is in the frame;

the lens having a first edge adjacent to the illumination mechanism for receiving light into the lens to make the lens marking visible;

wherein the frame is a rectangular three sided frame extending downward from the base for receiving the lens and for supporting the lens with the marking being in the first orientation relative to the housing, the three sided frame including parallel first and second frame side sections that are fixed to the base and extend downward from the base and a bottom frame section that extends between and interconnects outer end portions of the frame side sections, the bottom frame section being removable from the frame side sections to enable removal of the lens from the frame and insertion of the lens into the frame in a selected orientation, the bottom frame section when secured to the frame side sections blocking the lens from falling out of the frame when the exit sign is mounted on a building wall or ceiling;

the base enclosing electrical components of the exit sign assembly including:

internal electrical wiring;

a row of lamps arrayed along the lower side of the base and forming at least a part of the illumination mechanism;

a transformer which provides electric power to the row of lamps, the lower side of the base being open so that light from the row of lamps is directed into the interior of the frame to illuminate the lens; and a battery backup for the exit sign assembly;

mounting structure for supporting the exit sign on a wall or a ceiling, the mounting structure having an opening for receiving external electrical wiring to connect with the internal electrical wiring, thereby to enable the supply of electric power to the transformer and the lamps;

wherein the lens includes a coating on a light-transmitting material, the coating being selectively absent on at least one of the first and second major side surfaces of the lens to provide the marking, the coating being absent on the four edges of the lens; and including two fasteners for releasably fastening the bottom frame section to the first and second frame side sections, and wherein each fastener is a clip having an L-shaped configuration including one leg for connection with the bottom frame section and a second leg for connection with one of the first and second frame side sections.

2. An exit sign as set forth in claim 1 wherein each one of the first and second frame side sections has a slot for slidably receiving an edge portion of the lens during insertion of the lens into the frame.

3. An illuminated exit sign for mounting on a building structure and having markings for directing the movement of a person in the building, the exit sign comprising:

a housing; and a light transmitting lens removably supported in the housing, the lens having a marking for providing exit information to a viewer and having first and second major side surfaces;

the housing including a rectangular box-shaped base configured for mounting on a wall or a ceiling of a building, the base being a top portion of the sign when mounted on the ceiling;

the housing also including a frame and receiving the lens and supporting the lens with the marking in a first orientation relative to the housing;

the lens being free of electrical contacts and electrical terminals;

the exit sign including an illumination mechanism inside the base to direct light toward the lens to illuminate the lens when the lens is in the frame;

the lens having a first edge adjacent to the illumination mechanism for receiving light into the lens to make the lens marking visible;

wherein the frame is a rectangular three sided frame extending downward from the base for receiving the lens and for supporting the lens with the marking being in a first orientation relative to the housing, the three sided frame including parallel first and second frame side sections that are fixed to the base and extend downward from the base and a bottom frame section that extends between and interconnects outer end portions of the frame side sections, the bottom frame section being removable from the frame side sections to enable removal of the lens from the frame and insertion of the lens into the frame in a selected orientation, the bottom frame section when secured to the frame side sections blocking the lens from falling out of the frame when the exit sign is mounted on a building wall or ceiling;

the base enclosing electrical components of the exit sign assembly including:

internal electrical wiring;

a row of lamps arrayed along the lower side of the base and forming at least a part of the illumination mechanism;

a transformer which provides electric power to the row of lamps, the lower side of the base being open so that light from the row of lamps is directed into the interior of the frame to illuminate the lens; and a battery backup for the exit sign assembly;

mounting structure for supporting the exit sign on a wall or a ceiling, the mounting structure having an opening for receiving external electrical wiring to connect with the internal electrical wiring, thereby to enable the supply of electric power to the transformer and the lamps;

wherein the lens includes a coating on a light-transmitting material, the coating being selectively absent on at least one of the first and second major side surfaces of the lens to provide the marking, the coating being absent on the four edges of the lens.

4. An exit sign as set forth in claim 3 including two fasteners for releasably fastening the bottom frame section to the first and second frame side sections, and wherein each fastener is a clip having an L-shaped configuration including one leg for connection with the bottom frame section and a second leg for connection with one of the first and second frame side sections.

5. An exit sign as set forth in claim 4 wherein each one of the first and second frame side sections has a slot for slidably receiving an edge portion of the lens during insertion of the lens into the frame.

6. An illuminated exit sign as set forth in claim 5 wherein each one of the first and second frame side sections and the bottom frame section has a generally triangular cross sectional shape providing a beveled configuration and appearance on both sides to the three sided frame.

7. An illuminated exit sign as set forth in claim 6 wherein at the inner apex of each one of the first and second frame side sections and the bottom frame section there is located an inside slot for receiving an edge of the lens.

* * * * *